US010982813B2

(12) United States Patent
Mucci

(10) Patent No.: US 10,982,813 B2
(45) Date of Patent: Apr. 20, 2021

(54) CONNECTING ELEMENT FOR GAS CYLINDERS

(71) Applicant: CIS S.R.L., Pogno (IT)

(72) Inventor: Antonello Mucci, Borgomanero (IT)

(73) Assignee: CIS S.R.L., Briga Novarese (IT)

( * ) Notice: Subject to any disclaimer, the term of this patent is extended or adjusted under 35 U.S.C. 154(b) by 0 days.

(21) Appl. No.: 16/362,811

(22) Filed: Mar. 25, 2019

(65) Prior Publication Data

US 2019/0293240 A1 Sep. 26, 2019

(30) Foreign Application Priority Data

Mar. 26, 2018 (IT) ..... 102018000003931

(51) Int. Cl.
*F17C 13/04* (2006.01)

(52) U.S. Cl.
CPC ..... *F17C 13/04* (2013.01); *F17C 2205/0323* (2013.01); *F17C 2205/0373* (2013.01); *F17C 2221/013* (2013.01); *F17C 2260/036* (2013.01)

(58) Field of Classification Search
CPC ..... F17C 2205/0373; F17C 2260/036; F17C 13/04; F16K 1/308
See application file for complete search history.

(56) References Cited

U.S. PATENT DOCUMENTS 4,660,595 A * 4/1987 Kuster ..... E21D 15/512 137/494
2008/0289700 A1* 11/2008 Masingale ..... F16K 1/307 137/461

FOREIGN PATENT DOCUMENTS

GB 966967 A * 8/1964 ..... F16K 1/303
WO 2012/095810 A1 7/2012

* cited by examiner

*Primary Examiner* — Angelisa L. Hicks
(74) *Attorney, Agent, or Firm* — Nixon & Vanderhye

(57) ABSTRACT

Disclosed is a connecting element for connecting a device or apparatus to a gas cylinder provided with coupling element including at least one external thread, the connecting element including a body with a hollow cylindrical section provided with an internal thread adapted for joining with the external thread of the gas cylinder, an annular gasket, an annular seat adapted for housing the gasket, the seat including at least one perimeter surface on which the gasket rests. The body includes one or more bleed channels, each with a first end that opens on to the perimeter surface of the seat of the gasket and a second end that opens on to an outer surface of the body so that the bleed channel places the seat of the gasket in communication with the external atmosphere.

11 Claims, 4 Drawing Sheets

CONNECTING ELEMENT FOR GAS CYLINDERS

BACKGROUND OF THE INVENTION

Field of the Invention

The present invention concerns a connecting element for connecting devices or apparatus, such as a pressure reducer, to a gas cylinder. More in detail, the invention concerns a connecting element adapted for joining with closing and/or adjustment means of a gas cylinder containing pressurized gas. The invention further concerns a pressure reducer integrating this connecting element.

Description of the Related Art

To dispense "draft" beverages, such as carbonated water, beer, soft drinks or the like, the use of inert gases, such as carbon dioxide, nitrogen or mixtures thereof, contained in pressurized gas cylinders, is known.

These gas cylinders are provided with closing, and optionally adjustment, means, equipped with connection means that allow various devices, such as pressure reducers, connectors, pipes or the like, to be connected to the gas cylinder. In general, said connection means comprise an external thread and an annular flat surface coaxial with said thread; Said closing means normally comprise a needle valve, also coaxial with said thread.

A known connecting element that allows a device or accessory to be connected to a gas cylinder like the one described above is mentioned in WO 2012/095810 A1.

Said connecting element is provided with a body with an internal thread, adapted for housing the external thread of the gas cylinder, and a corresponding annular surface coaxial with said internal thread.

Connection of the connecting element to the gas cylinder takes place by screwing said connecting element until the two respective annular surfaces abut.

The seal is guaranteed by a gasket housed in a seat made in an area of contact of the two annular surfaces; this area is interposed between said corresponding flat annular surfaces. The connecting element, during its clamping on the gas cylinder, deforms the gasket that, being pressed in its seat, responds with an elastic reaction, both on the bottom of the seat an on the annular surface of the connection means of the gas cylinder, so that the gasket ensures gas-tightness at high pressures.

The connection device described above nonetheless has some drawbacks.

In fact, it has been found that during use a minimum amount of pressurized gas seeps between the gasket and the surface of its seat. This condition has no effect on the seal of the connecting element when it is applied to the gas cylinder. However, when this connection is disconnected from the gas cylinder, i.e. when the annular surface of the connection is moved away from the gasket, the volume of pressurized gas that remains trapped between the gasket and its seat exerts a thrust on the gasket causing it to exit, even only partially, from said seat. This event is often unknown to the operator who removes the gas cylinder, for example to replace it with a full one, so that during connection of the connector to another gas cylinder, the portion of gasket not perfectly inserted in the seat is crushed or "pinched" improperly by the annular surface of the body of the connection causing both gas leakages and irreversible damage of the gasket that must be replaced.

SUMMARY OF THE INVENTION

In this context, the object of the present invention is to propose a connecting element for gas cylinders that overcomes the aforesaid problems of the prior art.

In detail, the object of the invention is to propose a connecting element for connection of a device to a gas cylinder, which guarantees the correct positioning of the gasket in its seat.

In particular, the object of the invention is to propose a connecting element that guarantees greater duration of the sealing gasket.

Another object of the present invention is to provide a connection that provides correct seal even after numerous operations to connect and disconnect the connecting element.

A further object of the present invention is to produce a connecting element of simple manufacture that has no substantial constructive complications or increased cost relative to known connecting elements.

These and other objects are achieved by the present invention with a connecting element for connecting a device or apparatus to a gas cylinder provided with connection means comprising at least one external thread, wherein said connecting element comprises at least:

- a body with a hollow cylindrical section provided with an internal thread, adapted for joining with the external thread of the connection means of the gas cylinder;
- an annular sealing gasket;
- an annular seat, made in the body, adapted for housing said gasket.

The seat has at least one perimeter surface on which an outer surface of the gasket rests. Moreover, the body comprises one or more bleed channels, each with a first end that opens on to said perimeter surface of the seat of the gasket and a second end that opens on to an outer surface of the body. Therefore, each bleed channel places the seat of the gasket in communication with the external atmosphere. More precisely, the channel places the area of the seat comprised between the outer surface of the gasket and the perimeter surface of the seat in communication with the external atmosphere. As mentioned above, when the connection is mounted on a gas cylinder containing a pressurized gas, a limited volume of pressurized gas tends to accumulate in this area which, in known connections, can nonetheless cause the gasket to exit from the seat.

In the connection of the present invention, each bleed channel allows this albeit minimum amount of gas to flow outward, preventing it from accumulating between the gasket and the perimeter surface of the seat.

In this way, when the connection is disconnected from the gas cylinder, and hence the pressure that the connection element of the gas cylinder exerts on the gasket is relieved, this latter remains correctly positioned in its seat.

According to an aspect of the invention, the connecting element can comprise several bleed channels. Preferably, said bleed channels are angularly equidistant from one another with respect to the axis of the perimeter surface of the seat. According to the invention, the number of said channels is preferably comprised between two and eight. According to a preferred embodiment, the number of bleed channels is four.

The passage cross-section of each bleed channel is preferably comprised between 0.10 $mm^2$ and 1.2 $mm^2$ and more preferably between 0.20 $mm^2$ and 0.50 $mm^2$.

The size of this cross-section is naturally dependent on the number of bleed channels present.

This size, combined with the number of bleed channels indicated, makes it possible to prevent pressure pockets from being created between the gasket and the seat and, at the same time, ensures correct seal, i.e., at most with gas leaks that are totally negligible and not dangerous.

According to an aspect of the invention, said perimeter surface of the seat can comprise at least one side wall, preferably cylindrical or substantially cylindrical, and an annular bottom wall, preferably flat. In this case, the first end of the bleed channel can open on to one of said walls.

When the bleed channels are two or more, at least a first end of a bleed channel opens on to the side wall and at least a first end of another channel opens on to the bottom wall.

In this way, due also to the presence of several channels, bleed is obtained uniformly on the whole of the perimeter surface preventing isolated gas pockets from remaining.

For this purpose, to facilitate communication between the area comprised between the gasket and the side wall and the area comprised between the gasket and the bottom wall, the side surface of said gasket can comprise one or more notches. Said notches are substantially linear and extend for a section or along the whole of the thickness of the side wall of the gasket. Said notches are preferably substantially parallel to the axis of the perimeter wall of the seat.

According to a preferred embodiment, said notches have a V-shaped cross section. The notches are preferably numbering between two and eight and more preferably four.

According to an aspect of the invention, said connecting element can be connectable in turn to a device such as, for example, a pressure reducer, a pipe, a control unit or other gas distribution devices, or can be integrated in one of said devices.

In the first case, said connecting element comprises a coupling element for connection to the aforesaid device, such as a further cylindrical portion provided with an internal or external thread.

In the second case, the connecting element is typically produced in one piece with the body of the device.

BRIEF DESCRIPTION OF THE DRAWINGS

Further features and details of the invention will be better understood from the description below, provided by way of non-limiting example, and from the accompanying drawings, wherein.

DESCRIPTION OF THE PREFERRED EMBODIMENTS

Figure 1:
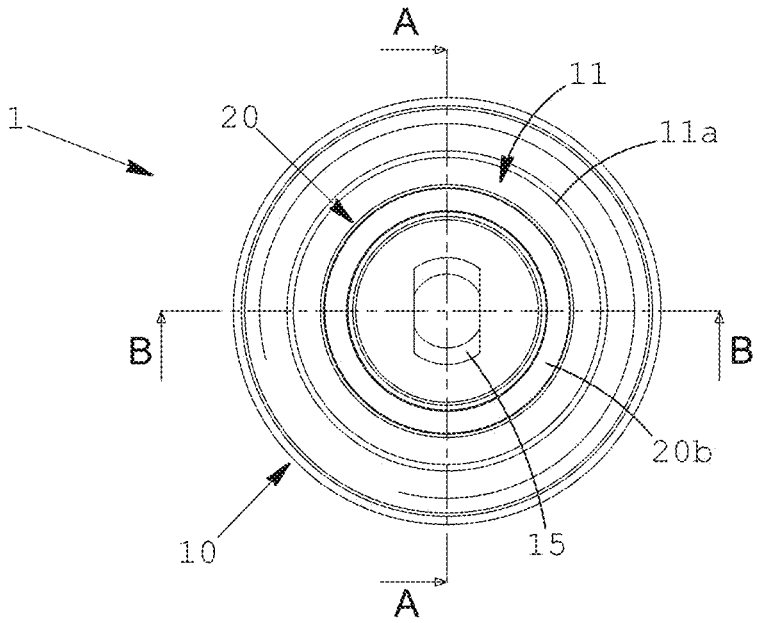
FIG. 1 is a plan view of a connecting element according to an embodiment of the invention.
Figure 2A:
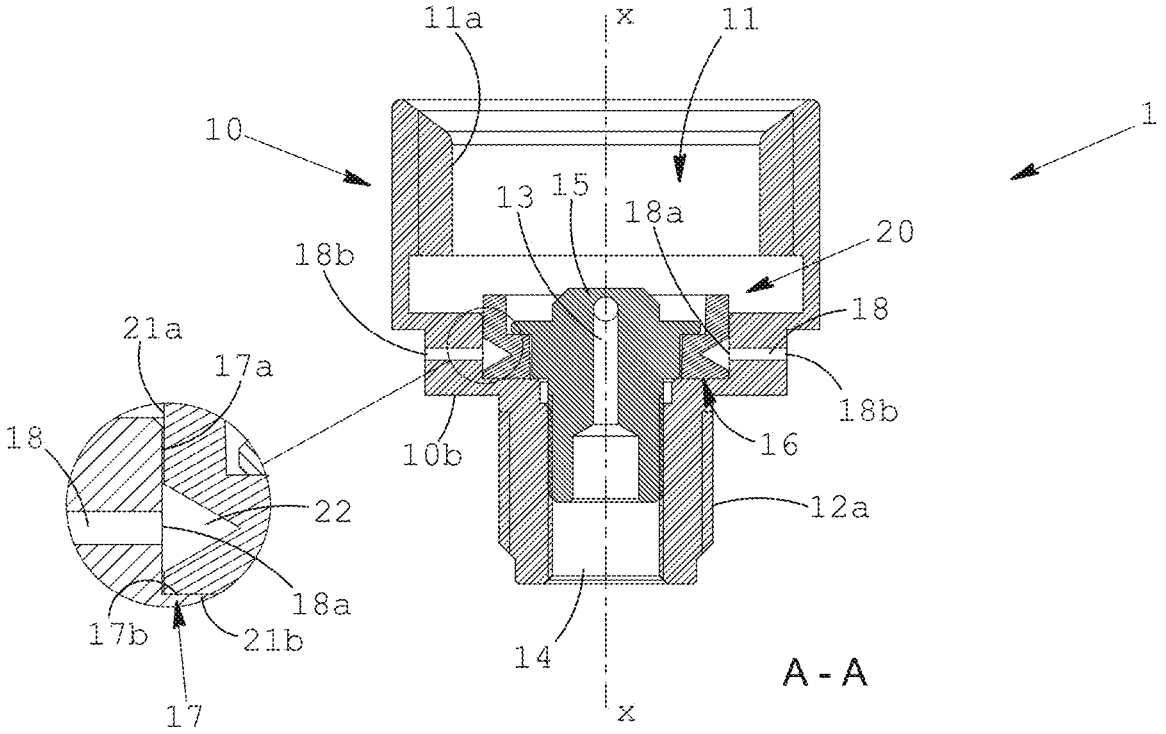
FIGS. 2*a* and 2*b* are side sectional views according to respective transverse planes A-A and B-B, of the connecting element of FIG. 1.
Figure 2B:
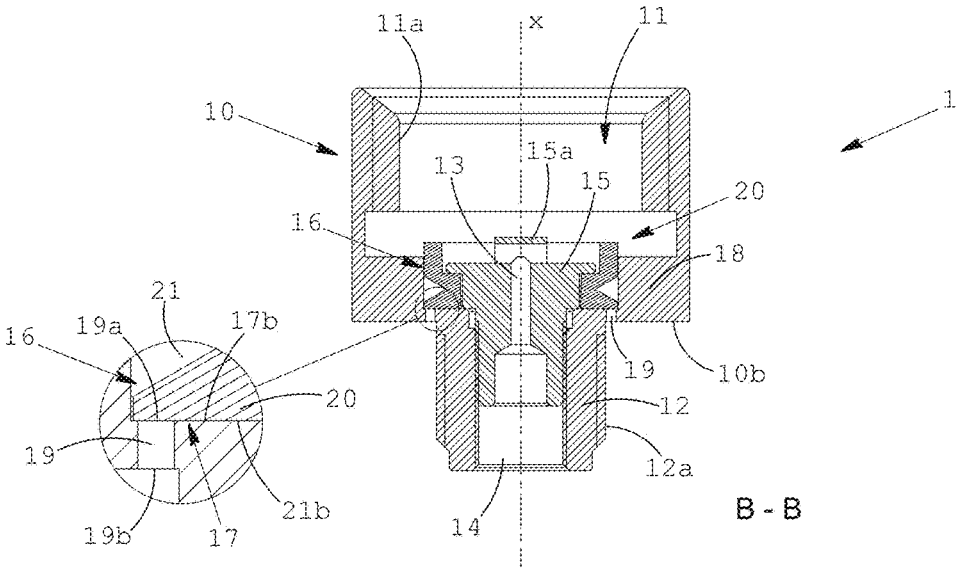

With reference to the accompanying FIGS. 1, 2*a* and 2*b*, the number 1 indicates as a whole a connecting element according to the invention, for connecting a gas cylinder, generally filled with pressurized gas, to a device, an apparatus, an accessory or the like.

In the example illustrated in the aforesaid figures, the connecting element can be used as adapter element to be interposed between the gas cylinder and the aforesaid device to be connected.

The connecting element 1 comprises a body 10 with a cylindrical cavity 11 provided with an internal thread 11*a* with an axis X. As mentioned above, said thread 11*a* is adapted for joining by screwing with a corresponding threaded portion of the connection means of the gas cylinder, which are known and standardized, and therefore not indicated in the accompanying figures.

The body 10 also comprises a further coupling element 12 that allows connection of the connecting element to the device or apparatus to be placed in communication with the gas cylinder.

According to a preferred variant, said coupling element 12 is provided with connection means such as a thread 12*a*, as in the example of the figures, or other known connection means, such as quick release elements or the like. Said thread 12*a* is preferably coaxial with the thread 11*a* of the cylindrical cavity 11.

A gas passage 13 that places the cylindrical cavity 11, which acts as gas inlet, in communication with the gas outlet 14, is made in the coupling element 12.

Preferably, said gas passage 13 is made in an insert 15, mounted in the body 10, provided with an abutment surface 15*a* adapted for coacting with the needle valve of the closing means of the gas cylinder (not illustrated).

The seal of the pressurized gas is provided by an annular gasket 20 housed in an annular seat 16 made in the body 10. The gasket 20 and the seat 16 preferably share the same axis X of the cylindrical cavity 11.

The seat 16 is defined by at least one perimeter surface 17 on which the outer surface 21 of the gasket 20 rests.

Figure 3A:
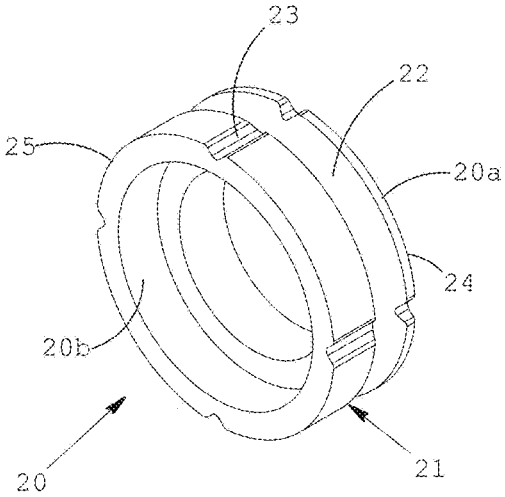
FIGS. 3*a* and 3*b* are respectively a perspective view and a plan view of the sealing gasket according to the invention.
Figure 3B:
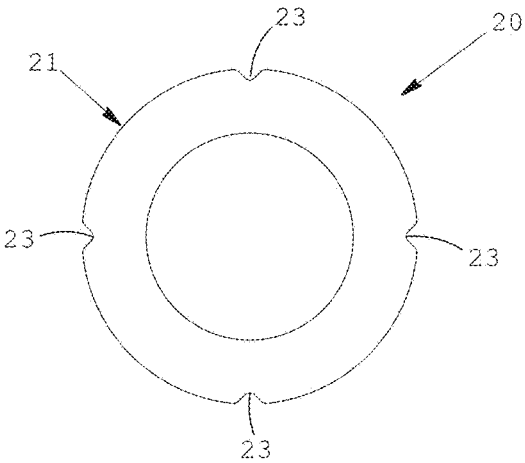

Observing FIGS. 3*a* and 3*b*, in which the gasket 20 is shown in detail, it can be noted how it comprises a first annular portion 20*a*, adapted for being inserted completely in the seat 16, and a second annular portion 20*b* which defines a lip protruding from said seat 16 (FIGS. 2*a*, 2*b*).

When the threaded portion of the gas cylinder is screwed into the threaded cavity 12, said protruding lip 20*b* is pressed by a corresponding annular surface of the connection means of the gas cylinder to ensure the seal.

In the example of the figures the gasket 20 has a substantially polygonal cross-section. In detail, the outer surface 21 of the gasket comprises a side surface 21*a* and a head surface 21*b*.

The perimeter surface 17 of the seat 16 in turn comprises a side wall 17*a*, on which the side surface 21*a* of the gasket rests and a bottom wall 17*b* on which the head surface 21*b* of the gasket 20 rests.

The gasket 20 is typically made of a polymer material, preferably an elastomer, which ensures sufficient elasticity to enable the gasket to deform elastically when the connecting element is joined to the connection means of the gas cylinder.

For this purpose, preferably, an annular groove 22 is made on the side surface 21*a* of the gasket to enable greater deformation also of the first annular portion 20*b*, when the surface of the connection means of the gas cylinder presses against the lip 20*b*.

In accordance with the invention, bleed channels are made in the body 10 to allow any pressurized gas trapped between the perimeter surface 17 of the seat 16 and the outer surface 21 of the gasket 20 to flow toward the outside.

Consequently, said bleed channels place the seat 16 of the gasket in communication with the outside.

According to a preferred embodiment, the connecting element comprises a pair of bleed channels 18 each having a first end 18*a* that opens on to the side wall 17*a* of the perimeter surface 17 and a second end 18*b* that opens on to a point on the outer surface 10*b* of the body 10 (FIG. 2*a*).

Each bleed channel 18 thus allows any pressurized gas that seeps between the side surface 21*a* of the gasket and the side wall 17*a* of the seat 16 to be discharged toward the outside, preventing it from remaining trapped between them.

Said bleed channels 18 are preferably arranged radially or substantially radially with respect to the axis X of the seat 16. Said bleed channels are preferably placed opposite each other, i.e. staggered angularly by 180°. Moreover, said bleed channels 18 are preferably rectilinear, or composed of several rectilinear sections, so as to be made simply by perforating the body 10. This solution reduces the times and the costs required to produce the connecting element.

The connecting element also comprises a further pair of bleed channels 19 each having a first end 19*a* that opens on to the bottom wall 17*b* of the perimeter surface 17 and a second end 19*b* that opens in a point on to the outer surface 10*b* of the body 10 (FIG. 2*b*).

Each bleed channel 19 instead allows any pressurized gas that seeps between the head surface 21*b* of the gasket and the bottom wall 17*b* of the seat 16 to be discharged toward the outside, preventing it from remaining trapped between them.

Also the bleed channels 19 are preferably rectilinear. In the example of the figures, said bleed channels are substantially parallel to the axis X of the seat 16, but could also be inclined slightly, for example divergent from said axis X.

Preferably, the two bleed channels 19 are angularly staggered by 180° between them and staggered by 90° with respect to each bleed channel 18.

According to the invention, the number and the position of the bleed channels can vary as a function of the size of the connecting element and of the passage cross-section of each channel.

Preferably, the total passage cross-section of the bleed channels 18, 19 is comprised between 0.4 $mm^2$ and 4 $mm^2$ and more preferably between 0.8 $mm^2$ and 2 $mm^2$.

Tests carried out by the applicant showed that with a number of bleed channels comprised between two and eight and a passage cross-section with the aforementioned values, the gasket 20 is not displaced from its seat 16 when the connecting element is disconnected from the connection means of the gas cylinder and at the same time that said connecting element ensures correct gas seal with entirely negligible seepage.

According to a preferred variant, the bleed channels 18, 19 are four and have a passage cross-section each of around 0.25 $mm^2$.

According to a preferred variant, the gasket 20 is provided with notches 23 on the side surface 21*a* to facilitate communication between different points of the seat 16 (FIGS. 3*a*, 3*b*). In particular, said notches 23 place the area comprised between the side surface 21*a* of the gasket and the side wall 17*a* of the seat 16 and the area between the head surface 21*b* of the gasket and the bottom wall 17*b* of the seat 16 in communication.

In this way, the formation of isolated pockets that cannot be ejected through the bleed channels is avoided.

The notches preferably extend between a lower edge 24 and an upper edge 25 of the gasket 20. The notches are preferably rectilinear and arranged along a direction substantially parallel to the axis of the gasket 20 (coincident with the axis X of the seat).

According to a preferred embodiment, said notches 23 are numbering between two to eight and preferably four.

The notches preferably have a V-shaped cross section, but can also have different shapes, such as square, rectangular, semi-circular or the like.

Figure 4A:
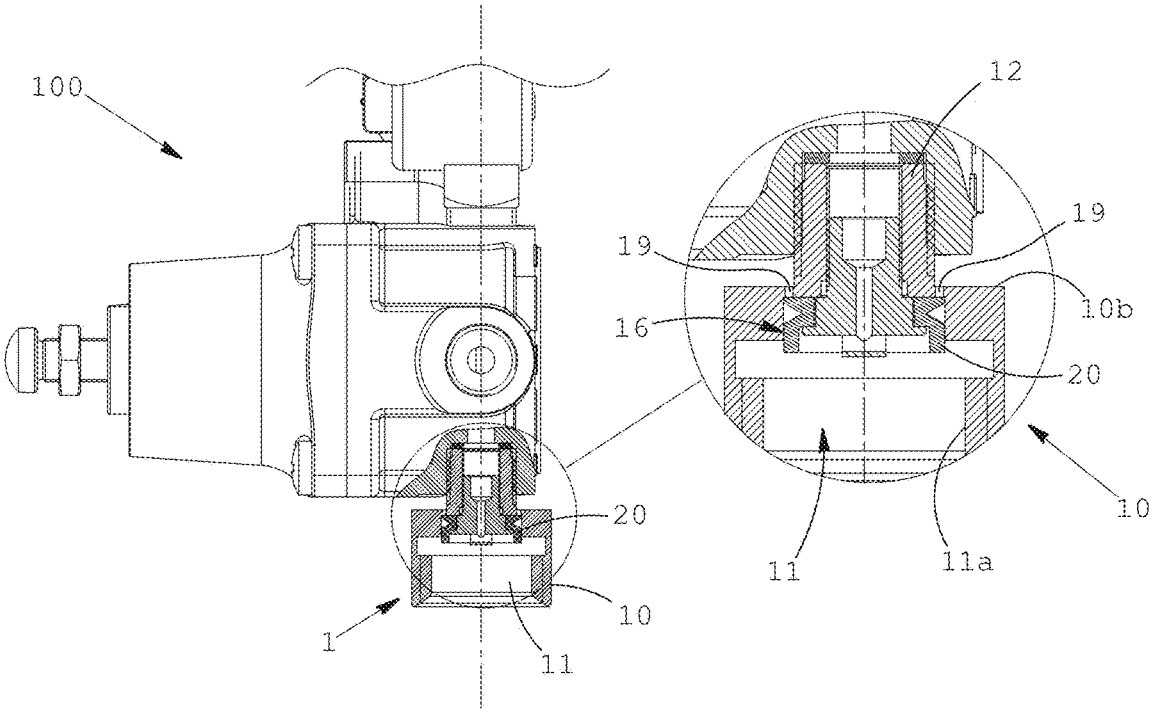
FIGS. 4*a* and 4*b* are two side sectional views, on respective transverse planes, of the connecting element of FIG. 1 applied to a pressure reducer device.
Figure 4B:
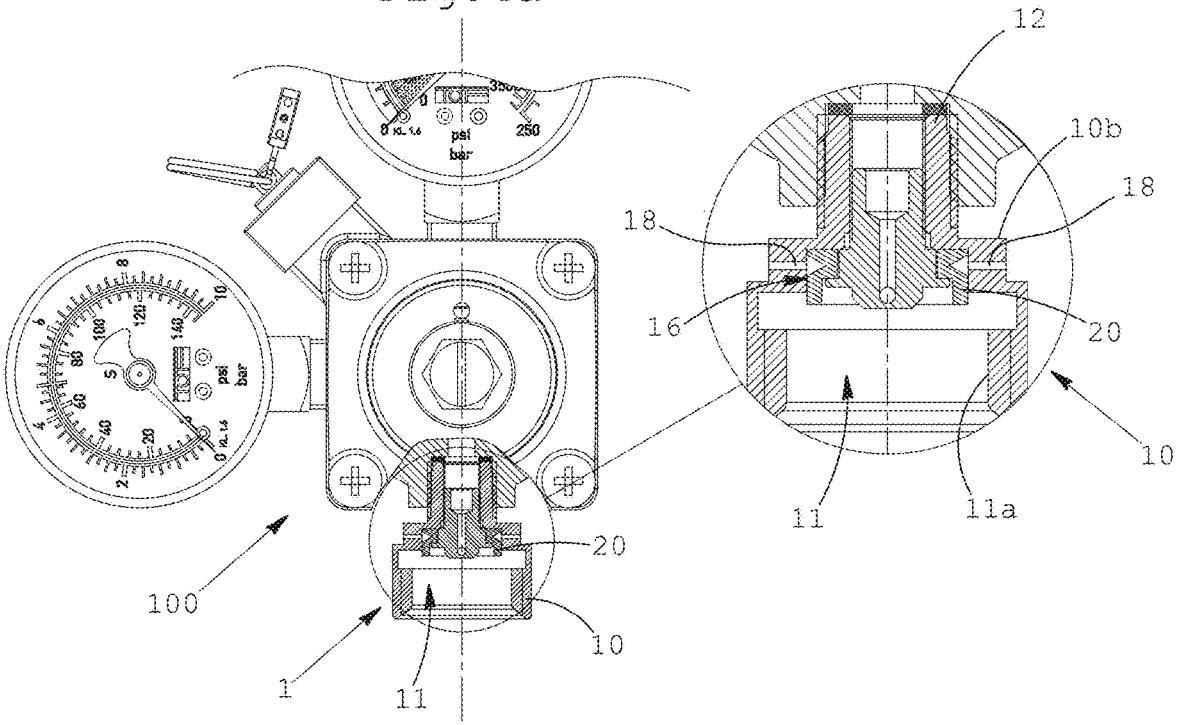

FIGS. 4*a* and 4*b* illustrate the connecting element 1 connected to a pressure reducer indicated with 100.

As can be seen in these figures, the reducer device 100 is connected to the connecting element 1 at the threaded coupling element 12.

The pressure reducer is known per se and therefore will not be described in detail.

The assembly composed by the connecting element 1 and by the pressure reducer 100 can therefore be connected to the connection means of a gas cylinder, not illustrated, by means of the internal thread 11*a* of the cylindrical cavity 11.

Figure 5B:
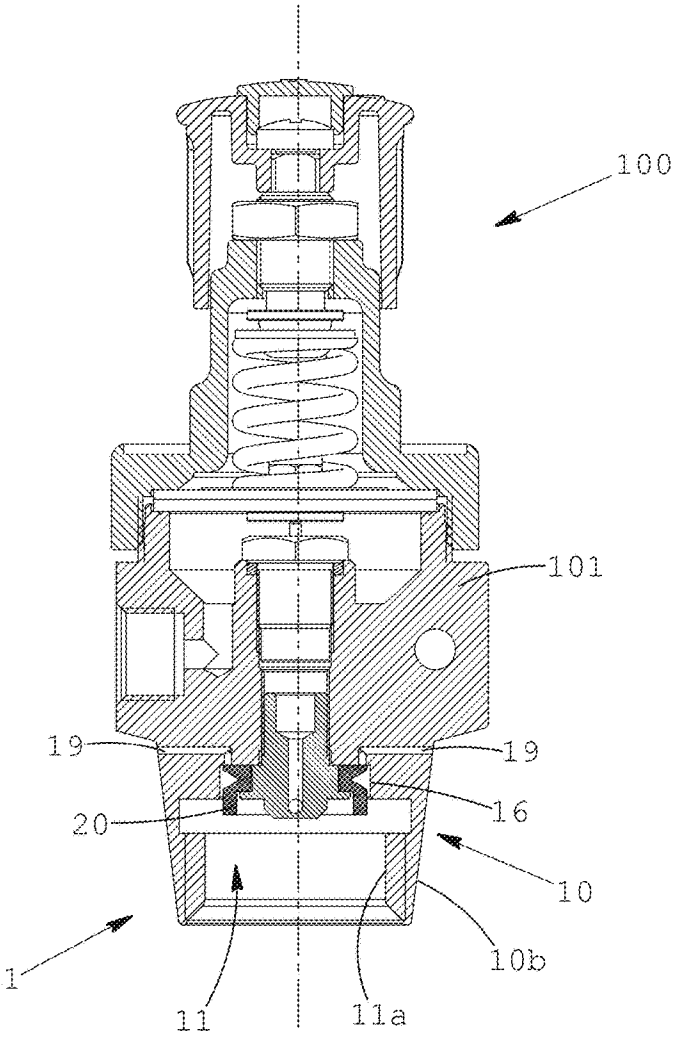
FIGS. 5*a* and 5*b* are two side sectional views, on respective transverse planes, of a pressure reducer device in which the connecting element according to the present invention is integrated.
Figure 5A:
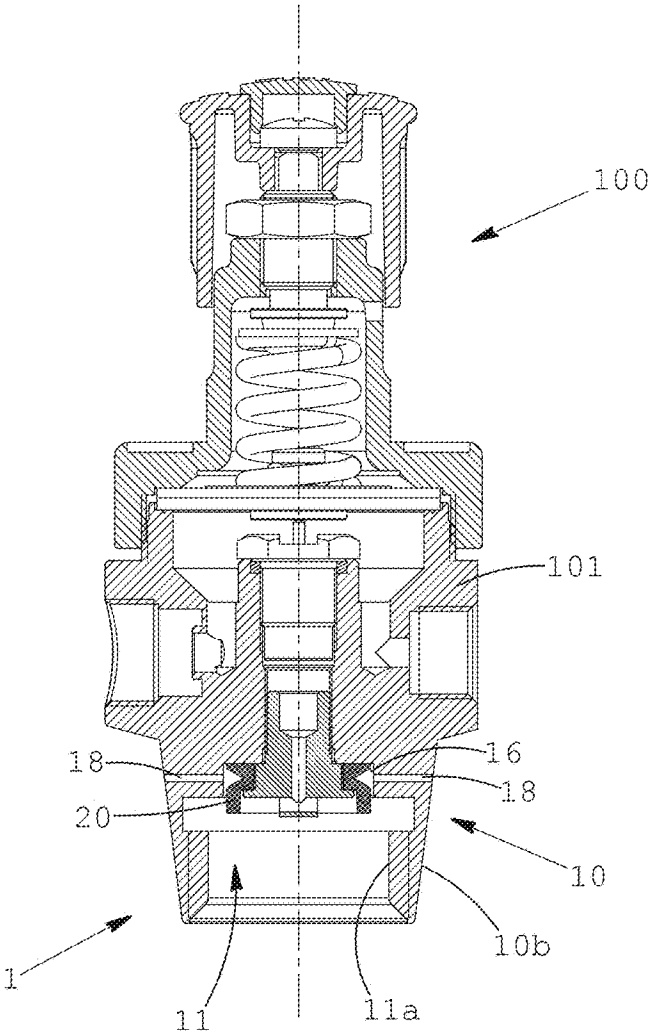

The accompanying FIGS. 5*a* and 5*b* illustrate a pressure reducer 100 in which the connecting element according to the invention is integrated.

In detail, the body 10 of the connecting element 1 is typically made in one piece with the body 101 of the pressure reducer 100.

In the aforesaid figures, the numbering of the parts of the connecting element is the same used for the respective common parts illustrated in the example of FIGS. 1 to 3.

In the example illustrated, the connecting element is not provided with the coupling element 12 as its body 10 is made in one piece with the body of the reducer. The two parts, the connecting element 1 and the body 101 of the pressure reducer, can in any case be separate and can be joined by coupling means having a dedicated shape and compatible only with the aforesaid object.

In this example, the connecting element 1 acts as a high pressure gas inlet for the pressure reducer. The internal thread 11*a* of the cavity 11 can be joined to the connection means of the gas cylinder (not illustrated).

The remaining parts of the pressure reducer are well known to the person skilled in the art and therefore shall not be described in detail.

The invention has been described purely for illustrative and non-limiting purposes, according to some preferred embodiments. Those skilled in the art may find numerous other embodiments and variants, all falling within the scope of protection of the claims below.

The invention claimed is:

1. A connecting element for connecting a device or apparatus to a gas cylinder provided with connecting means having at least one external thread, said connecting element comprising:

a body with a hollow cylindrical section provided with an internal thread adapted for joining with said external thread of the connecting means on the gas cylinder;

an annular gasket; and an annular seat, made in the body, adapted for housing said gasket, said seat comprising at least one perimeter surface on which the gasket rests, wherein the body comprises two or more bleed channels, each with a first end that opens on to said perimeter surface of the seat of the gasket and a second end that opens on to an outer surface of the body so that said bleed channel places the seat of the gasket in communication with the external atmosphere, wherein the first end of a first of said two or more bleed channels opens on to a side wall of the seat of the gasket, and wherein the first end of a second of said two or more bleed channels opens on to a bottom wall of the seat of the gasket.

2. The element according to claim 1, wherein the body comprises between two and eight of said bleed channels.

3. The element according to claim 2, wherein the total passage cross-section of the bleed channels is between 0.4 $mm^2$ and 4 $mm^2$.

4. The element according to claim 2, wherein said bleed channels are straight.

5. The element according to claim 1, wherein said bleed channels are angularly equidistant from one another with respect to an axis (X) of the annular seat.

6. The element according to claim 5, wherein the total passage cross-section of the bleed channels is between 0.4 $mm^2$ and 4 $mm^2$.

7. The element according to claim 1, wherein the total passage cross-section of the bleed channels is between 0.4 $mm^2$ and 4 $mm^2$.

8. The element according to claim 1, wherein said bleed channels are straight.

9. The element according to claim 1, wherein on the side surface of the gasket there is at least one notch that extends for a section or along the entire thickness of said side wall.

10. The element according to claim 9, wherein the gasket is provided with several notches numbering between two and eight.

11. A device or apparatus that can be connected to a gas cylinder, comprising a connecting element according to claim 1.

* * * * *